US007601005B1

(12) United States Patent
Lai

(10) Patent No.: US 7,601,005 B1
(45) Date of Patent: Oct. 13, 2009

(54) DISTRIBUTOR STRUCTURED FOR A 360-DEGREE ROTARY CEILING FAN

(75) Inventor: Hou-Chen Lai, Tanzih Township, Taichung County (TW)

(73) Assignee: Air Cool Industrial Co., Ltd., Taichung County (TW)

( * ) Notice: Subject to any disclaimer, the term of this patent is extended or adjusted under 35 U.S.C. 154(b) by 0 days.

(21) Appl. No.: 12/234,672

(22) Filed: Sep. 21, 2008

(51) Int. Cl.
*H01R 39/00* (2006.01)

(52) U.S. Cl. ..... 439/12

(58) Field of Classification Search ..... 439/12, 439/11, 22, 27, 164
See application file for complete search history.

(56) References Cited

U.S. PATENT DOCUMENTS 2,832,940 A * 4/1958 Furpahs ..... 439/22
5,013,224 A * 5/1991 Liao ..... 417/423.5
5,082,448 A * 1/1992 Kang ..... 439/22

* cited by examiner

*Primary Examiner*—Phuong K Dinh
(74) *Attorney, Agent, or Firm*—Ming Chow; Sinorica, LLC

(57) ABSTRACT

A distributor structured for a 360-degree rotary ceiling fan comprises a main housing with an outer shell and a pedestal, a central shaft passing through the outer shell and the pedestal, and a power distribution ring unit around the central shaft in the main housing. The power distribution ring unit comprises several electrically conductive ring units and insulation ring units. The electrically conductive ring units are interlaced with the insulation ring units. One terminal of the electrically conductive ring unit is connected to an external power supply, while the other one is connected to a ceiling fan. The carbon brush being used, the environment even may be prevented from being polluted and the human body may be prevented from being harmed, the carbon brush does not easily bring poor electric conduction caused by dust, and the issues on difficult periodical replacement and maintenance of the carbon brush is solved.

6 Claims, 6 Drawing Sheets

DISTRIBUTOR STRUCTURED FOR A 360-DEGREE ROTARY CEILING FAN

BACKGROUND OF THE INVENTION

1. Field of the Invention

This invention relates to a distributor structured for a 360-degree rotary ceiling fan.

2. Description of the Related Art

With reference to FIG. 1 as a 3D exploded view illustrating a distributor for a conventional 360-degree rotary fan, a power distribution turnplate 1 comprises a rotary axis 11 pivoted onto a fixed plate 12. A power distribution ring unit 13 is further set around the rotary axis 11 with a bolt 133 as a fixture. The power distribution ring unit 13 is further divided into several insulation rings 131 and electrically conductive copper rings 132. Further, an anchor block 14 is provided on the fixed plate 12. A bi-way hollow receiving hole 141 is formed at an inner side of the anchor block 14. The receiving hole 141 is formed with a spring 142 and a carbon brush 143. An electrically conductive strip 144 is provided outside the anchor block 14 opposite to the receiving hole 141. The electrically conductive strip 144 is connected to an electrical wire 145, while the electrical wire 145 is connected to power. Next, when the carbon brush 143 that is sustained by the spring 142 with elasticity supports the electrically conductive copper ring 132, the spring 142 may be used to suppress the electrically conductive strip 144, and thus the electrically conductive copper ring 132, the carbon brush 143, and the electrical wire 145 are formed into a loop communicating with each other.

On the conventional power distribution turnplate 1, the carbon brush 143 is used to form the electric loop so that the carried fan 360 may run at 360 degrees for uniform heat dissipation. Being used over a long period of time, the carbon brush 143 is polluted with dust and thus causes poor electrical conduction. The carbon brush 143 contains carbon powder with poisonous lead that is harmful to human body and pollutes the environment. Further, the carbon brush 143 must be replaced periodically and is not easily maintained, so improvement is necessarily made.

Consequently, because of the technical defects of described above, the applicant keeps on carving unflaggingly through wholehearted experience and research to develop the present invention, which can effectively improve the defects described above.

SUMMARY OF THE INVENTION

A distributor for a 360-degree rotary ceiling fan according to this invention is provided on a turnplate. The distributor further comprises a main housing, a central shaft, and a power distribution ring unit. The main housing comprises an outer shell and a pedestal, in which the outer shell is connected to the pedestal. The outer shell's sealing side is formed with a thru hole, and its outer circumferential wall is formed with a lead-wire thru slot. A second thru hole is mostly formed in the center of pedestal. Further, the pedestal I connected to the turnplate. The central shaft meanwhile passes through the first and second holes and its outer circumferential wall is formed axially with several long wedge slots. A shift limit slot is formed in the central shaft opposite to the top of another side of the pedestal. Next, four rib lumps are formed around between the wedge slots and limited between the outer shell and the pedestal. Next, the power distribution ring unit is set around the central shaft and arranged in the main housing, and comprises a plurality of electrically conductive ring units and insulation ring units. The electrically conductive ring units is interlaced with the insulation ring units. Besides, one terminal of the electrically conductive ring unit is connected to an external power source, while the other one is connected to a ceiling fan. Thus, even if the carbon brush is used, the environment may be prevented from being polluted and the human body may be prevented from being harmed, the carbon brush is not apt to bring poor electric conduction caused by dust, and the issues on difficult periodical replacement and maintenance of the carbon brush is even solved.

DETAILED DESCRIPTION OF THE PREFERRED EMBODIMENTS

Now, the present invention will be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
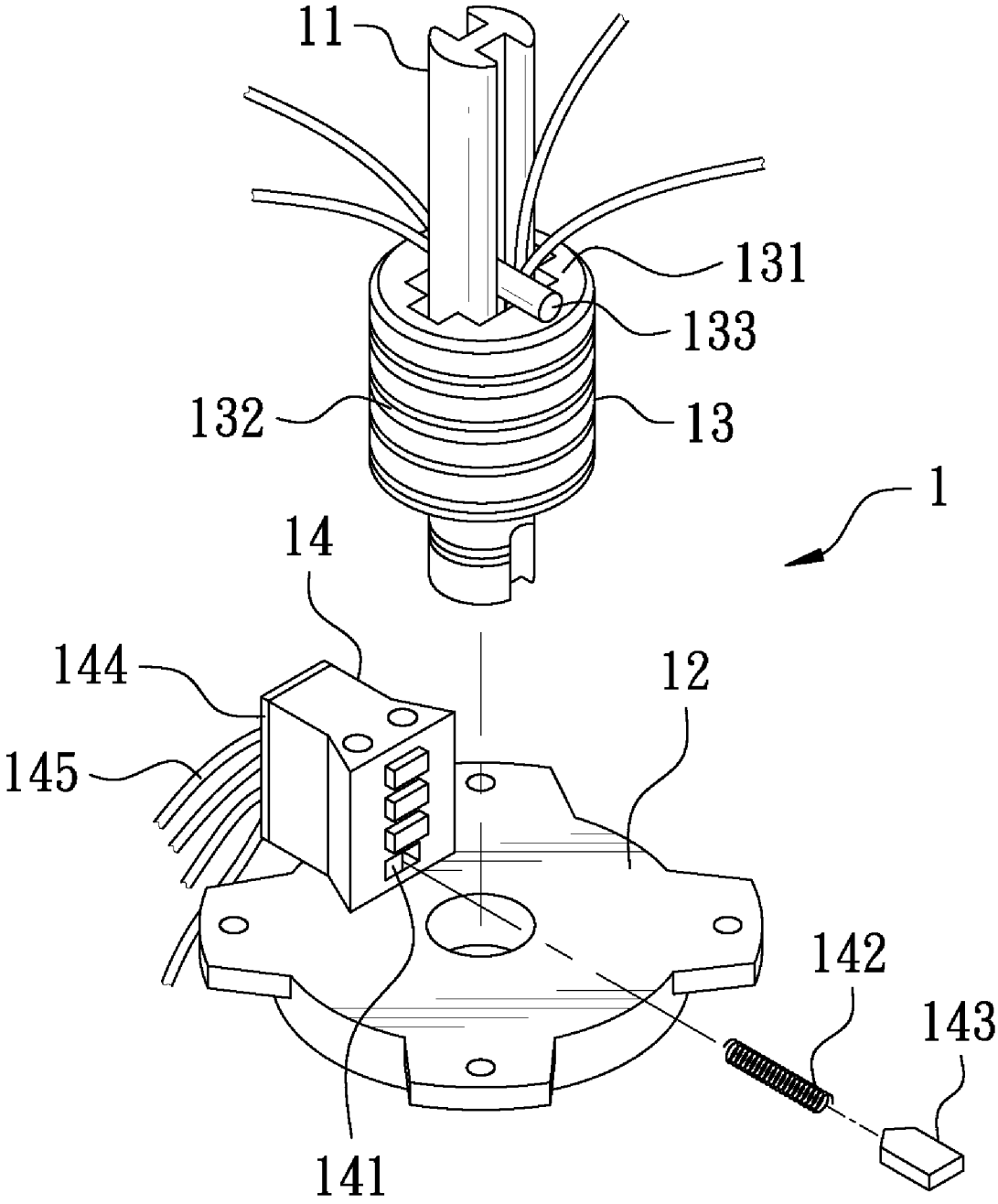
FIG. 1 PRIOR ART
FIG. 1 is a 3D exploded view of a conventional distributor for a 360-degree rotary fan.
Figure 2:
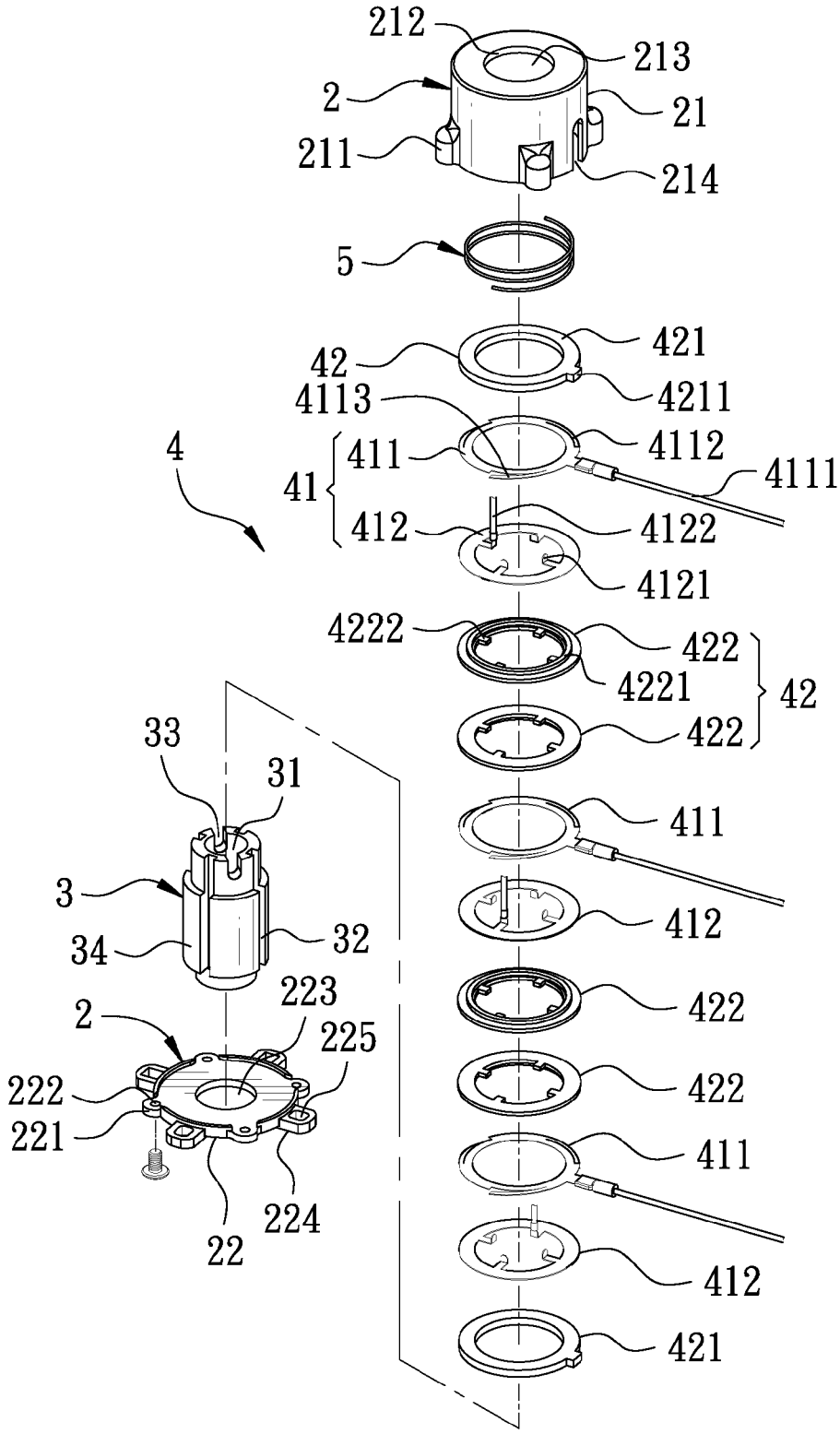
FIG. 2 is a 3D exploded view of a distributor for a 360-degree rotary ceiling fan according to this invention.
Figure 3:
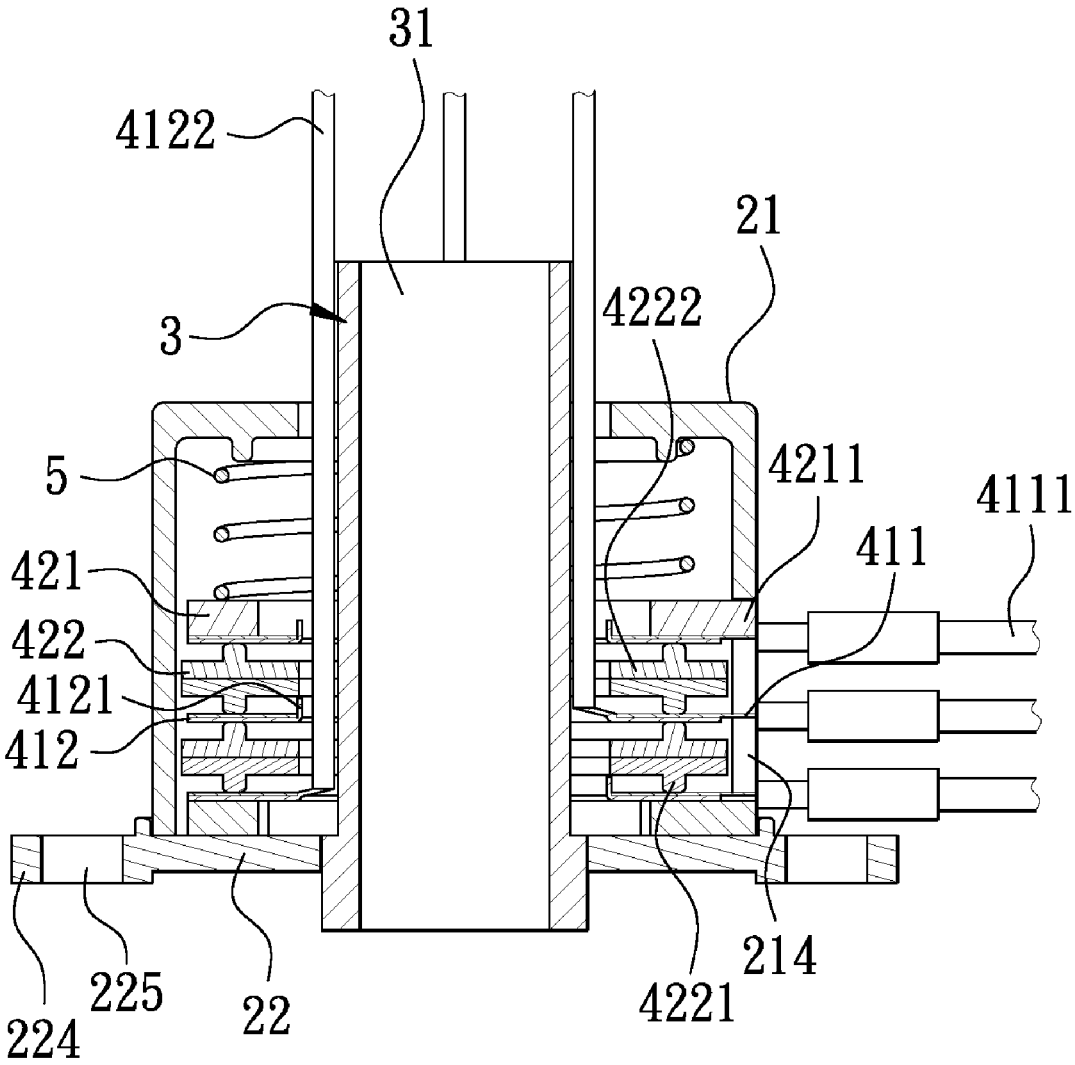
FIG. 3 is a sectional assembly view of a distributor for a 360-degree rotary ceiling fan according to this invention.

With reference to FIGS. 2 and 3 shown respectively as a 3D sectional view and a sectional assembly view that illustrate a distributor for a 360-degree rotary ceiling fan according to this invention, the distributor comprises a main housing 2, a central shaft 3, a power distribution ring unit 4, and an elastic part 5.

The main housing 2 comprises an outer shell 21 and a pedestal 22. The outer shell 21 is a cylinder and its outer circumferential wall is formed with four locking mounts 211 each of which has inner threads (not shown). Further, the sealing side of outer shell 21 is formed with a thru hole 212 and a chamber 213, and a long strip of lead-wire thru slot 214 passing through the chamber 213 is formed stretching upwards from the bottom of outer circumferential wall. The lead-wire thru slot 214 is further provided between the locking mounts 211 adjacent to each other. Next, the pedestal 22 is a round plate the center of which is formed with a second thru hole 223. The first thru hole 212 communicates with the second thru hole 223. The outer circumferential side of the pedestal 22 is formed with tabs 221 opposite to the locking mounts 211, in which a thru hole 222 is formed in the center of each of the tabs 221. The locking mounts 211 of the outer shell 21 are fixed with screws to the tabs 221 of the pedestal 22. Even, the outer circumferential side of the pedestal 22 is formed in a radial direction with four locking tabs 224 the center of which are respectively formed with a thru hole 225.

The central shaft 3 meanwhile passes through the first hole 212 and the second hole 223. The central shaft 3 is a tube and is provided with a chamber 31, and its outer circumferential wall is formed axially with four long wedge slots 32 that are spaced at intervals. A shift limit slot 33 is formed in the central shaft 3 opposite to the top of another side of the pedestal 22 and is arranged opposite to each of the wedge slots 32 close together. Next, four rib lumps 34 are formed around between the wedge slots 32 and limited between the outer shell 21 and the pedestal 22.

The power distribution ring unit 4 is set around the central shaft 3 and comprises a plurality of electrically conductive ring units 41 and insulation ring units 42. The electrically conductive ring units 41 are interlaced with the insulation ring units 42. In a preferred embodiment of this invention, the power distribution ring unit 4 comprises three electrically conductive ring units 41 and is provided for a front wire, a neutral wire, and a ground wire of the power supply. Each of the electrically conductive ring units 41 comprises a first electrically conductive ring 411 and a second electrically conductive ring 412. A lead wire 4111 is provided at the outer circumferential side of first electrically conductive ring 411, passes through the lead-wire thru slot 214, and stretches outwards for power output. In the preferred embodiment of this invention, three projecting flakes 4112 spaced downwards are provided at the outer circumferential side of the first electrically conductive ring 411 and are metal molded by stamping. The second electrically conductive ring 412 is arranged below the first electrically conductive ring 411, and its inner circumferential side is formed with shift limit teeth 4121 opposite and wedged to the wedge slots 32. An electrical wire 4122 is provided at one of the shift limit teeth 4121. The electrical wire 4122 is set in the wedge slot 32 and stretches upwards and connects to an external power supply (not shown) for power input.

Figure 4:
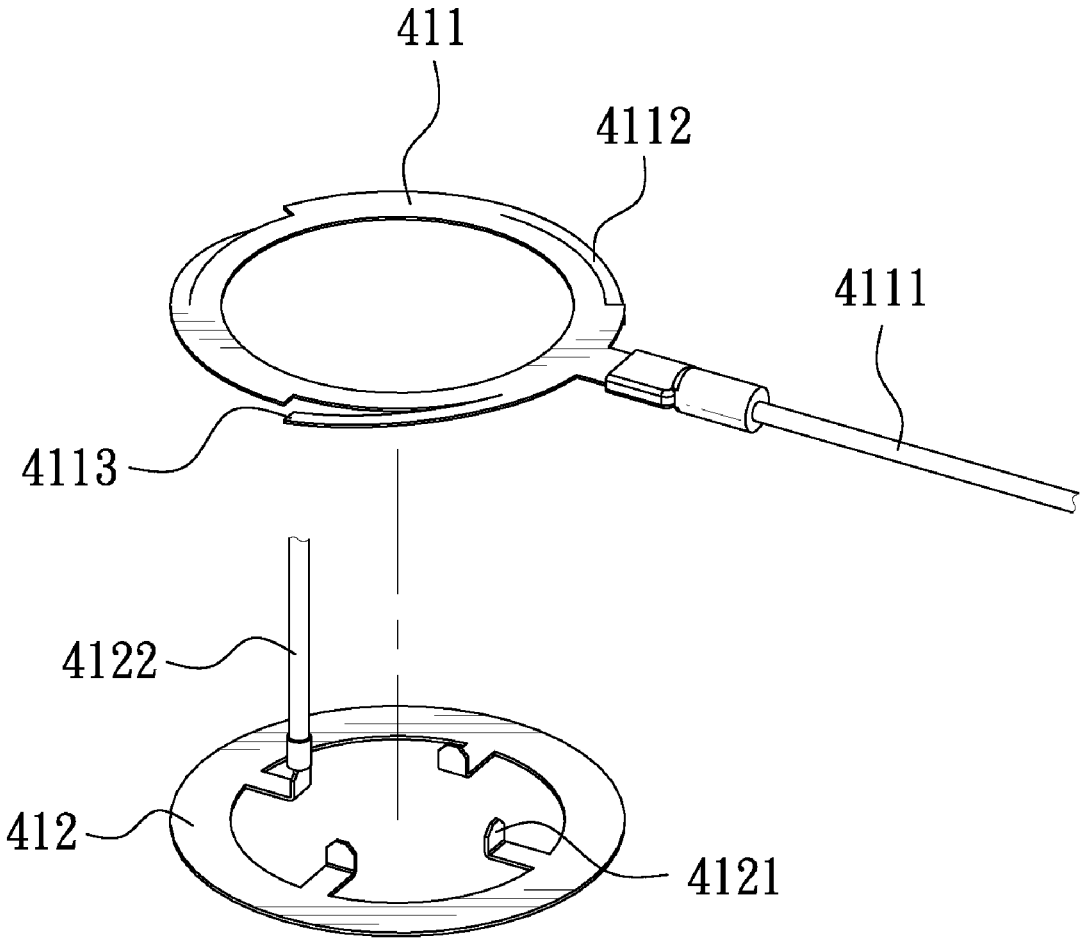
FIG. 4 is a 3D view of a partial electrically conductive ring unit according to this invention.

With reference to FIG. 4 shown as a 3D view of the partial electrically conductive ring unit according to this invention, the flake 4112 of the first electrically conductive ring 411 stretches downwards and its end is formed with a free end 4113. The free end 4113 touches the top surface of second electrically conductive ring 412. Further, each insulation ring unit 42 comprises 2 first insulation rings 421 and 4 second insulation rings 422. The first insulation ring 421 is provided separately on the upper and lower layers of the power distribution ring unit 4, and its outer circumferential side is formed with a positioning tooth 4211. The positioning tooth 4211 passes through and wedges to the lead-wire thru slot 214. The second insulation rings 422 are respectively provided between the electrically conductive ring units 41. In the preferred embodiment of this invention, between the electrically conductive ring units 41 adjacent to each other, 2 second insulation rings 422 are provided and arranged oppositely. A flange 4221 is provided axially around the surface of one side of the second insulation ring 422. The flange 4221 touches the electrically conductive ring unit 41 and its inner circumferential wall is formed with the shift limit teeth 4222 being opposite and wedging to the wedge slots 32.

The elastic part 5 is provided in the housing 2 and set around the central shaft 3 and above the power distribution ring unit 4. In the preferred embodiment of this invention, the elastic part 5 is a compression spring.

Figure 5:
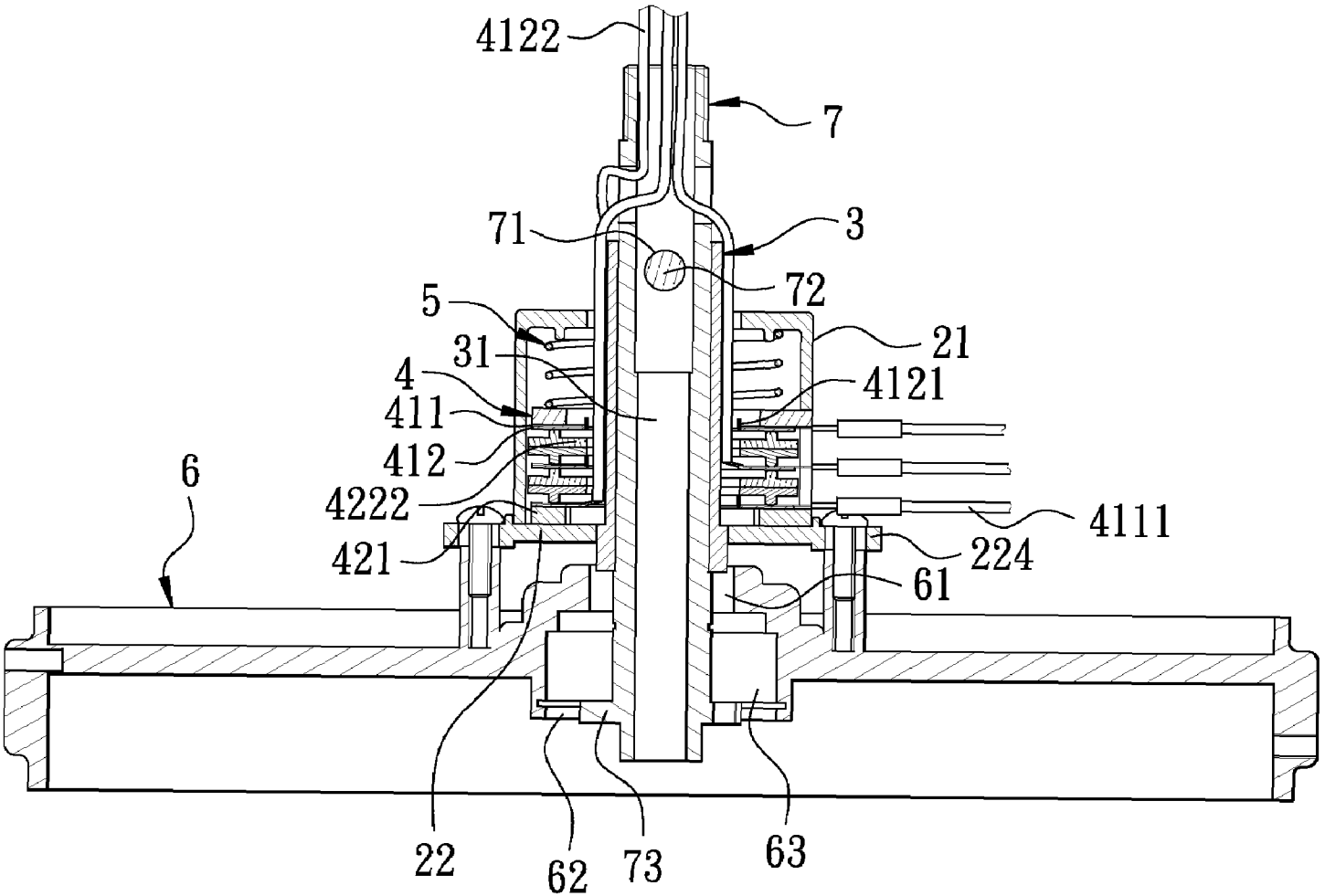
FIG. 5 is a sectional assembly view of the distributor for the 360-degree rotary ceiling fan according to this invention that is arranged on a turnplate.

With reference to FIG. 5 shown as a sectional assembly view of the distributor for the 360-degree rotary ceiling fan according to this invention that is arranged on a turnplate, the distributor is provided on a turnplate 6. A thru hole 61 the two sides of which are hollow is formed in the center of turnplate 6. A chamber 62 is formed in the thru hole 61, inside which a bearing 63 is provided. Further, the central shaft 3 passes through the center of housing 21 and pedestal 22 and limited thereinto. The central shaft 3 is wrapped by the elastic part 5 and the power distribution ring unit 4 and arranged in the main housing 2. With the elastic part 5, the first electrically conductive ring 411 may touch the second electrically conductive ring 412.

With reference to FIG. 2 shown as a partial 3D view of the electrically conductive ring unit according to this invention, several flakes 4112 on the surface of first electrically conductive ring 411 are used to reduce the friction caused between the first electrically conductive ring 411 and the second electrically conductive ring 412 at the time of turning. Next, the locking tab 224 of pedestal 22 is connected with screws to the turnplate 6. When the turnplate 6 turns, the distributor also synchronously turns. However, the inner circumferential walls of the second electrically conductive ring 412 and second insulation ring 422 are respectively formed with the shift limit teeth 4121 and 4222 and fixed into the wedge slot 32, so the central shaft 3, the second electrically conductive ring 412, and the second insulation ring 422 do not turn with the turnplate 6, but the first electrically conductive ring 411 does. In the manner of touch of the first electrically conductive ring 411 with the second electrically conductive ring 412, the power is transmitted from the second electrically conductive ring 412 to the first electrically conductive ring 411. Further, a conjunction rod 7 is provided in the chamber 31 of the central shaft 3. The conjunction rod 7 is provided with a locating pin hole 71 corresponding to the shift limit slot 33. A pin 72 is provided passing through the locating pin hole 71. The pin 72 is located and inserted into the locating pin hole 71 and the shift limit slot 33. The conjunction rod 7 is pivoted securely between the distributor and the turnplate 6. In the preferred embodiment of this invention, a shift limit ring 73 is provided in the conjunction rod 7 opposite to the circumferential wall of the bottom of bearing 63, in which the shift limit ring 73 is wedged to the bearing 63. Further, the locating pin hole 71 and the pin 72 are used for achievement of shift limit.

Figure 6:
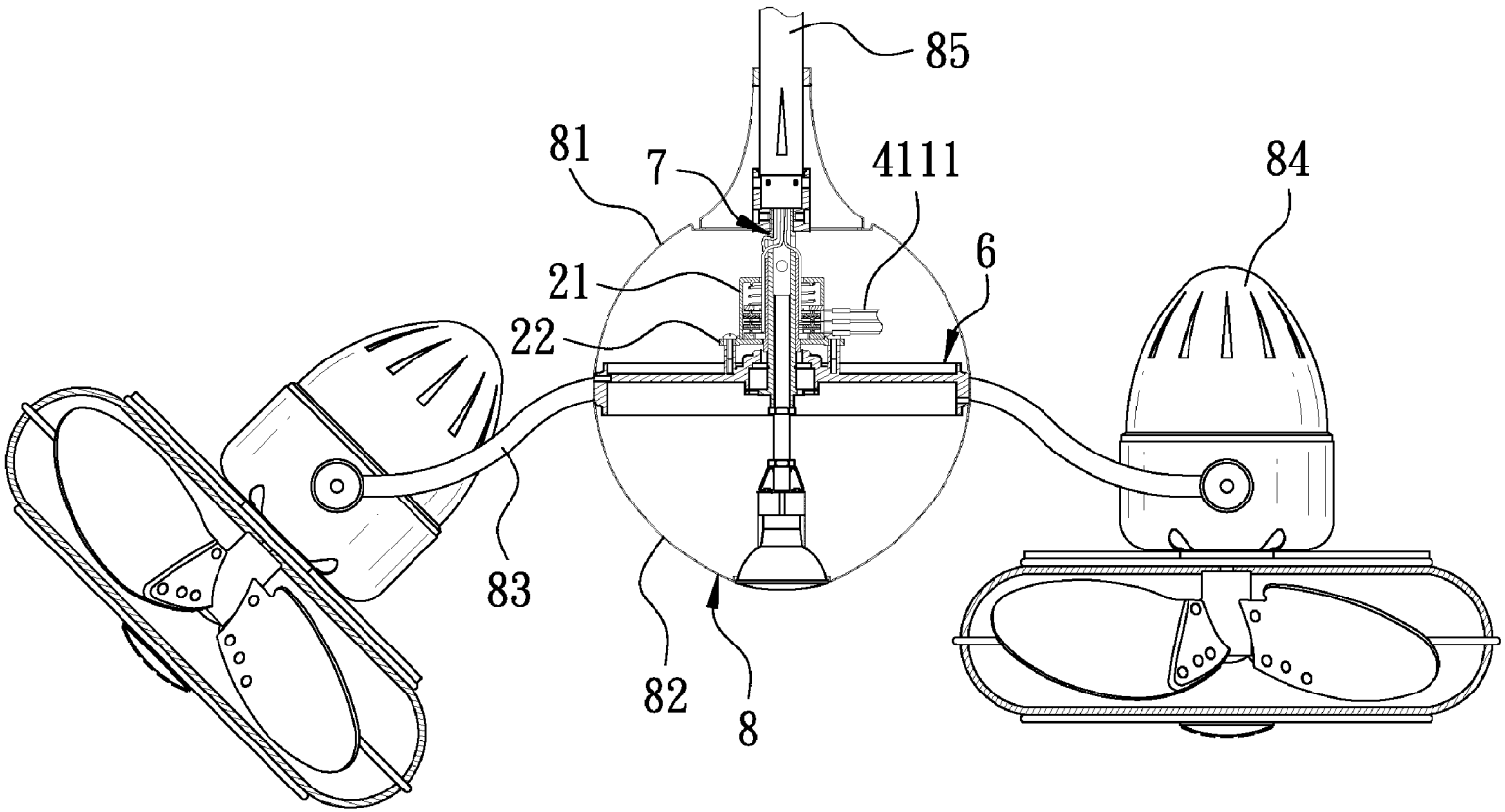
FIG. 6 is a partially sectional view of the distributor for the 360-degree rotary ceiling fan according to this invention that is assembled with a ceiling fan.

With reference to FIG. 6 shown as a partially sectional view of the distributor for the 360-degree rotary ceiling fan according to this invention that is assembled with a ceiling fan, the distributor is assembled with the turnplate 6 and then arranged in a cover 8. The cover 8 is divided into an upper cover 81 and a lower cover 82. The turnplate 6 is provided between the upper cover 81 and the lower cover 82. The two sides of turnplate 6 are respectively connected securely with two connecting rods 83 to a ceiling fan 84. The lead wires 4111 of the first electrically conductive ring 411 are separately connected to the ceiling fans 84. Even, a hanger 85 is securely connected to the conjunction rod 7 opposite to one side of the top of distributor, and the other terminal of the hanger 85 is securely arranged on the ceiling. Not being driven by a conventional motor, the turnplate 6 is driven by the running ceiling fans 84 causing counterforce to turn.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A distributor structured for a 360-degree rotary ceiling fan, its upper side being securely arranged by a hanger on the ceiling and its lower side being formed with a turnplate one side of which is formed with at least one ceiling fan, comprising:

a main housing provided with an outer shell and a pedestal, in which the outer shell is a cylinder connected to the pedestal, a center of sealing side of the outer shell is formed with a first thru hole and a chamber and its outer circumferential wall is formed with a lead-wire thru slot, the pedestal is a round plate the center of which is formed with a second thru hole communicating with the first thru hole, and the pedestal is securely connected to the turnplate;

a central shaft, a cylinder, passing through the first and second thru holes, in which its outer circumferential wall is formed axially with several long wedge slots, and several rib lumps are formed around in a center of outer circumferential wall of the central shaft, correspondingly arranged in the wedge slot, and wedged between the outer shell and the pedestal; and a power distribution ring unit being set around the central shaft and arranged in the main housing comprising a plurality of electrically conductive ring units and insulation ring units, in which the electrically conductive ring units are interlaced with the insulation ring units, and one terminal of the electrically conductive ring unit is connected to an external power supply and the other one is connected to a ceiling fan.

2. The distributor structured for the 360-degree rotary ceiling fan according to claim 1, wherein the power distribution ring unit comprises at least three electrically conductive ring units.

3. The distributor structured for the 360-degree rotary ceiling fan according to claim 1, wherein each of the electrically conductive ring units further comprises a first electrically conductive ring and a second electrically conductive ring, a lead wire is provided around the outer circumferential wall of the first electrically conductive ring, passes through the lead-wire thru slot, and stretches outwards to connect to the ceiling fan, an inner circumferential wall of second electrically conductive ring is formed with shift limit teeth corresponding and wedging to the wedge slots, one of the shift limit teeth is formed with an electrical wire that is arranged in the wedge slot and stretches upwards and connects to an external power supply, each insulation ring unit comprises a plurality of first insulation rings and second insulation rings, the first insulation ring is provided separately on the upper and lower layers of the power distribution ring unit, the second insulation rings are respectively provided between the electrically conductive ring units, and the inner circumferential wall is formed with the shift limit teeth being opposite and wedging to the wedge slots.

4. The distributor structured for the 360-degree rotary ceiling fan according to claim 1, wherein three projecting flakes spaced downwards are provided at the outer circumferential side of the first electrically conductive ring, and the end of each of the projecting flakes is formed with a free end touching a top surface of second electrically conductive ring.

5. The distributor structured for the 360-degree rotary ceiling fan according to claim 1, wherein the distributor comprises an elastic part provided in the main housing and set around the central shaft and above the power distribution ring unit.

6. The distributor structured for the 360-degree rotary ceiling fan according to claim 5, wherein the elastic part is a compression spring.

* * * * *